US006991342B2

(12) United States Patent
Gonet

(10) Patent No.: US 6,991,342 B2
(45) Date of Patent: Jan. 31, 2006

(54) FOOTWEAR WITH LIGHTING

(75) Inventor: Cindy Gonet, Florence (IT)

(73) Assignee: C & C Design S.r.l., Florence (IT)

( * ) Notice: Subject to any disclaimer, the term of this patent is extended or adjusted under 35 U.S.C. 154(b) by 0 days.

(21) Appl. No.: 10/753,046

(22) Filed: Jan. 7, 2004

(65) Prior Publication Data

US 2005/0002179 A1 Jan. 6, 2005

(30) Foreign Application Priority Data

Jan. 10, 2003 (IT) ..... FI2003A0007

(51) Int. Cl.
*F21V 21/08* (2006.01)

(52) U.S. Cl. ..... 362/103; 362/191; 362/276; 362/802; 36/137

(58) Field of Classification Search ..... 362/103, 362/191, 234, 253, 276, 396, 802; 36/137
See application file for complete search history.

(56) References Cited

U.S. PATENT DOCUMENTS

| | | | | |
|---|---|---|---|---|
| 4,848,009 A * | 7/1989 | Rodgers | ..... | 36/137 |
| 5,381,615 A * | 1/1995 | MacMillan | ..... | 36/137 |
| 5,663,614 A * | 9/1997 | Weng et al. | ..... | 362/103 |
| 5,865,523 A * | 2/1999 | Chien | ..... | 362/103 |
| 6,238,076 B1 * | 5/2001 | Pascale et al. | ..... | 362/276 |

* cited by examiner

*Primary Examiner*—Stephen F Husar
(74) *Attorney, Agent, or Firm*—Hedman & Costigan, P.C.

(57) ABSTRACT

Described herein is footwear and an inner sole for footwear, supplied with a lighting system that emits light at each step of the person who is wearing them only for the time necessary to see the path in front, and to turn off when he stops; and a lighting device for footwear supplied with means of fastening to footwear.

28 Claims, 4 Drawing Sheets

FOOTWEAR WITH LIGHTING

FIELD OF THE INVENTION

The invention refers to footwear supplied with a lighting system and adapted to light up the way of the person who is wearing the footwear.

PRIOR ART

Several models of footwear supplied with lighting systems are known, both fixed and removable, developed to help who wears these shoes to move about easily even at night and in the darkness, with the safety of who can see eventual obstacles.

These shoes 'with lighting' characteristically help people move around inside their own homes or in closed environments, safely, even in the dark.

It is frequent, in fact, that in the home and if there are children, toys and other objects can be found scattered on the floor, and a light source on shoes or slippers directed to light up the way, would allow who is wearing them not only to move around easily but also to avoid the risk of stumbling or falling due to obstacles.

The footwear supplied with lighting systems and of which the Applicant is aware, are more or less efficient in lighting the way of who wears them, but they emit a fixed light with waste of the battery that powers them.

These often deal with lighting devices that are bulky, anti-aesthetic and sometimes that must be assembled onto the outside of the footwear by way of hooks or springs that can be adapted with difficulty to any type of footwear, or use by the elderly or children.

For such, it would be advantageous to be able to use footwear supplied with a lighting system that emits light only when it is necessary to light the way, without waste of the battery and which can be assembled on any type of footwear without being heavy or anti-aesthetic.

SUMMARY OF THE INVENTION

For such a purpose, the Applicant developed the footwear according to the invention, in which light is emitted at each step of the person who is wearing them and only for the time necessary, and to turn off when he stops.

The lighting system of the invention is of small size and can be inserted during manufacture in any type of footwear, without affecting the aesthetic appeal of the footwear itself, or making it heavy.

It is therefore subject of the present invention, shoes supplied with a lighting system to light the way of who wears them, comprising a light source assembled on the external anterior surface of the shoe, a battery that powers said light source, a button positioned inside the inner sole of the shoe and activated by the pressure of the foot of support when walking, and a circuit connected to said button and to said light source by means of wires, said circuit controlling the lighting of said light source following the pressing of said button and on which a timer is set, such that if at a first pressing of the button, a second pressing does not follow in a predetermined period of time, the light source goes off.

A further subject of the invention is an inner sole for a shoe comprising a button positioned inside the sole structure and activated by pressure of the foot of support when walking, a light source assembled on a bracket with a clip suitable to be hooked to the upper or vamp of a shoe, a battery that powers said light source and a circuit connected to said button and to said light source by way of wires, that actuate lighting of said light source following pressing of said button and on which a timer is set such that if at a first pressing of the button, another pressing does not follow in a predetermined period of time, the light source goes off.

A still further subject of the invention is a lighting device for shoes comprising a light source, a battery that powers the said light source, a circuit connected to a balance switch and to the light source that activates lighting of the light source following movement of the shoe and on which a timer is set, such that if at a first movement of the shoe, another movement does not follow in a predetermined time, the light goes off, said battery, circuit and switch being inserted inside a housing supplied with a means of fastening to the shoe and of at least one opening, and said light source emerging from an extremity of the housing from which light emits.

BRIEF DESCRIPTION OF THE DRAWINGS

FIG. 2*a* shows a lateral view of the device, FIG. 2*b* a view from above of the device, and FIG. 2*c* and 2*d* show two sectional views of the device, with the various internal components.

DETAILED DESCRIPTION OF THE INVENTION

FIG. 1–4 described above are non limiting illustrations of the invention. With reference to FIG. 1–4 which are briefly described above, herein below follows a detailed description of the shoe and the lighting device fo the invention, its appliction and the advantages as compared to prior art.

Figure 1:
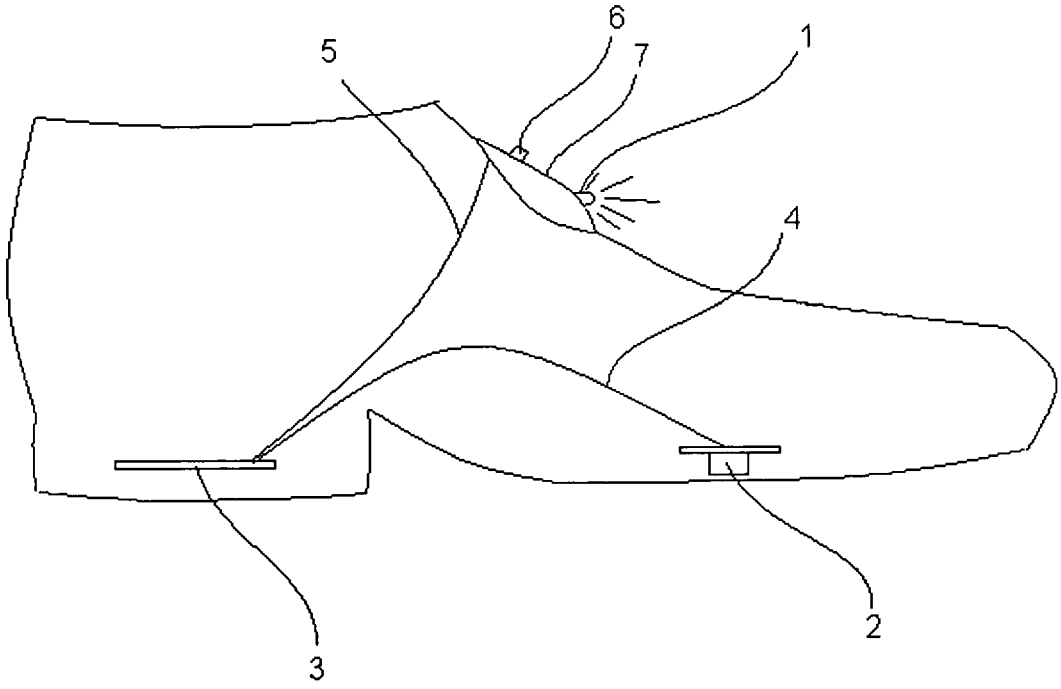
FIG. 1: lateral view of the shoe according to the invention, that shows in particular the arrangement inside the shoe of the various components of the lighting systems.
Figure 2:
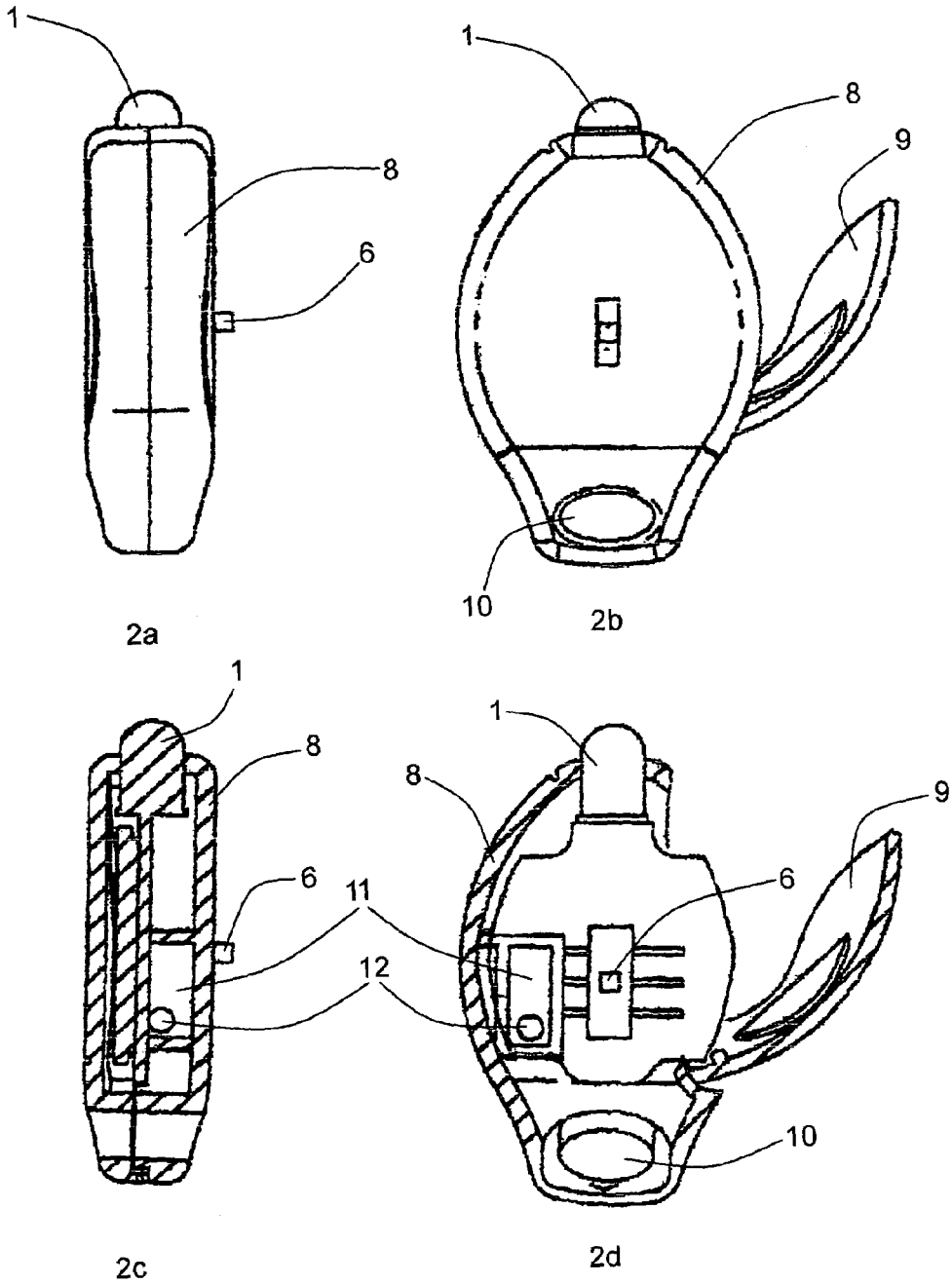
FIG. 2: some views of the lighting device for shoes according to the invention; in particular.

In FIG. 1 the light source 1 and the on/off switch 6 are shown, both inserted inside the housing 7; the electronic circuit 3 connected to the housing that holds the light source by way of electric wires 5; and the button 2 connected to the circuit with the electric wire 4.

Said light source, like the switch, are contained inside the housing 7, in such a position that the switch can be operated by who is wearing the shoe and the light source emits a beam of light directed frontally to light up the way of who is wearing the shoe.

Said housing 7 can be made for example in plastic, and can be fixed during the manufacture of the shoe, onto the anterior surface of the upper or vamp.

The light source preferably used for the realization of the shoe of the invention, is a LED—light emitting diode—connected by a switch 6 to the electric wire 5 that meets the circuit 3. The light source can be powered by any type of conventional battery, preferably light weight and small, for example, by a lithium battery. Said battery can be positioned on the circuit 3 or inside the housing 7.

The positioning of the battery inside the housing 7 is preferred because it allows removal of the dead battery and the substitution of a fresh battery; in this case the housing 7 will obviously have an opening that corresponds to the battery, to allow the operation of substitution of the battery.

The button 2 is preferably positioned inside the inner sole of the shoe, approximately in the central portion of the inner sole, as shown in FIG. 1. The button 2, in fact, must be pressed only when the person who wears the shoe is walking, it is therefore preferably located in the portion of the inner sole where the most weight rests when a person is walking.

The circuit 3, as shown in FIG. 1, is inserted inside the heel of the shoe. According to a preferred embodiment of the invention, said circuit 3 is a circuit in SMT—surface mounted technology-, miniaturized, that, thanks to its small size can be inserted in the housing 7 that contains also the light source. Thanks to the opening in the housing mentioned above, even the circuit can be substituted in case of breakage.

To said circuit 3 lead all of the functions of the lighting system according to the invention; when the button 2 is pressed, by way of the electric wires the circuit 3 activates the light source 1. The presence of the switch 6 in the lighting system according to the invention allows therefore to be able to use the footwear even during the day without consuming battery energy, because keeping the switch at the off position, the pressure made by the person wearing the shoes when he walks, does not cause lighting of the light source.

On the circuit 3, according to the invention, there is also a timer set such that if at a first pressing of the button 2, another does not follow in a certain predetermined time, the light source 1 goes out.

The period of time to which the present circuit is set is little more than the average time calculated necessary for a person to make a step: in this way the light source never goes out when a person is walking; whereas it goes out when a person has stopped walking. The time set on the circuit can be, for example, between 3 and 10 seconds, and preferably at 5 seconds.

The lighting system of the invention, as above illustrated, can be used on any type of footwear, particularly on indoor slippers; the shoes of the invention, in fact, in regard to products of prior art, are particularly useful for being worn in the home at night, or in a building where many people live, like hospitals or homes for the elderly, where there is the necessity of moving around inside a structure during the night without turning on conventional lights, disturbing the sleep of other people.

A further aim of the invention is an inner sole for footwear supplied with a timed lighting system as above described.

In this case, the button will be inserted inside the structure of the inner sole, preferably positioned in the heel of the user, whereas the light source, external to the structure of the inner sole and assembled on a bracket with hook, will be connected to the button by way of the circuit, preferably a circuit in SMT as above described, and of the electric wires, preferably in Teflon®. The light source can be inserted, even in this case, inside housing where the battery that powers the light source and the circuit are also positioned.

Any bracket with a clip that can be hooked to the anterior part of the upper-vamp-of the shoe can be used for the scope of the invention.

Any type of movable inner sole normally used in shoes to reduce the internal space or for better comfort and protection of the foot, can be used for the manufacture of the present soles by way of inserting inside the heel the button and/or the circuit above described.

The inner soles according to the invention, are particularly useful as they can be used in any type of shoe, even old shoes and for such, without any type of lighting system. Besides, the present sole can be easily inserted and removed from the shoe, being therefore suitable for use in several shoes of the same user.

In FIG. 2*a* is shown a lateral view of the device of the invention in which can be seen the on/off switch 6 and part of the light source 1 emerging from the housing 8. Even in this case, the light source is preferably a diode LED, whereas the housing 8 is preferably made of a rigid container in plastic material of ellipsoidal shape and thick enough to contain all of the components of the device.

In FIG. 2*b* can be seen instead the door 9 that allows access inside the housing for maintenance of the components, in particular of the battery, and its substitution when necessary, and the hole 10, that is one of the components for fastening the 30 device to the anterior surface of the upper-vamp-of the shoe.

In FIGS. 2*c* and 2*d*, the groove 11 inside which the sphere 12 is trapped, but free to move forward and backward along the groove; in its movement the sphere, generally in steel, causes the activation of the timed circuit to which are connected the functionality of the present device, according to the functioning of balance sphere switches known. Any other type of balance switch suitable for use in the present device could be used to embody the present invention, for example, spring switches in which the electric circuit is closed by movement of a weight positioned at the extremity of a spring, constrained at the other extremity but free to move with oscillating movements, like a pendulum.

Any movement of the shoe on which the present device is assembled is able to cause movement of the sphere, of the spring with weight or of any other mechanism that comprises a balance switch.

Similar to the above mentioned description for the shoe of FIG. 1, the circuit in the present device is such that if at a first movement of the shoe on which the device is assembled, and therefore of the sphere or of the spring with the weight, a second movement does not follow within a predetermined time, the light source goes off. Even in this case, the timer of the circuit is predetermined as said above, for the shoe of FIG. 1.

Figure 3:
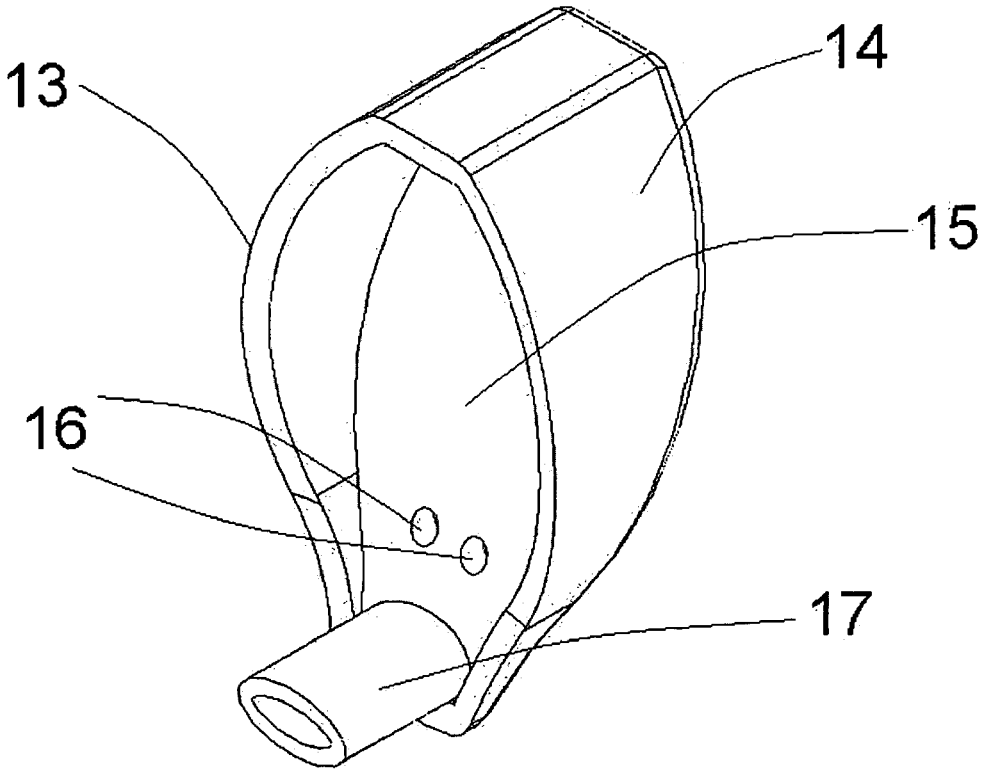
FIG. 3: shows a view from below and one of the possible means of hookin the device of FIG. 2 to the shoe.

Illustrated in FIG. 3 is a type of fastening system of the present device 13 to the shoe. The fastening to the shoe is made by way of two holes 16 through which the fastening system 13 is sewn to the upper of the shoe as if it were a button, whereas the assembly onto the system is made by way of a cylindrical protuberance 17 that engages itself with the hole 10 of the housing. The fastening system 13 is wedge formed with a flat surface 15 so as to lay on the upper of the shoe, and lateral walls 14 of degrading height, that delimit the hollow internal part.

For its particular form, the fastening system 13 has also the function of wedge creating an inclined thickness between the device and the shoe, that positions the beam of light at the correct height.

Besides the fastening system 13, any other fastener, such as springs, clips or glue, suitable to fix the device onto the upper of the shoe, can be used according to the invention.

Figure 4:
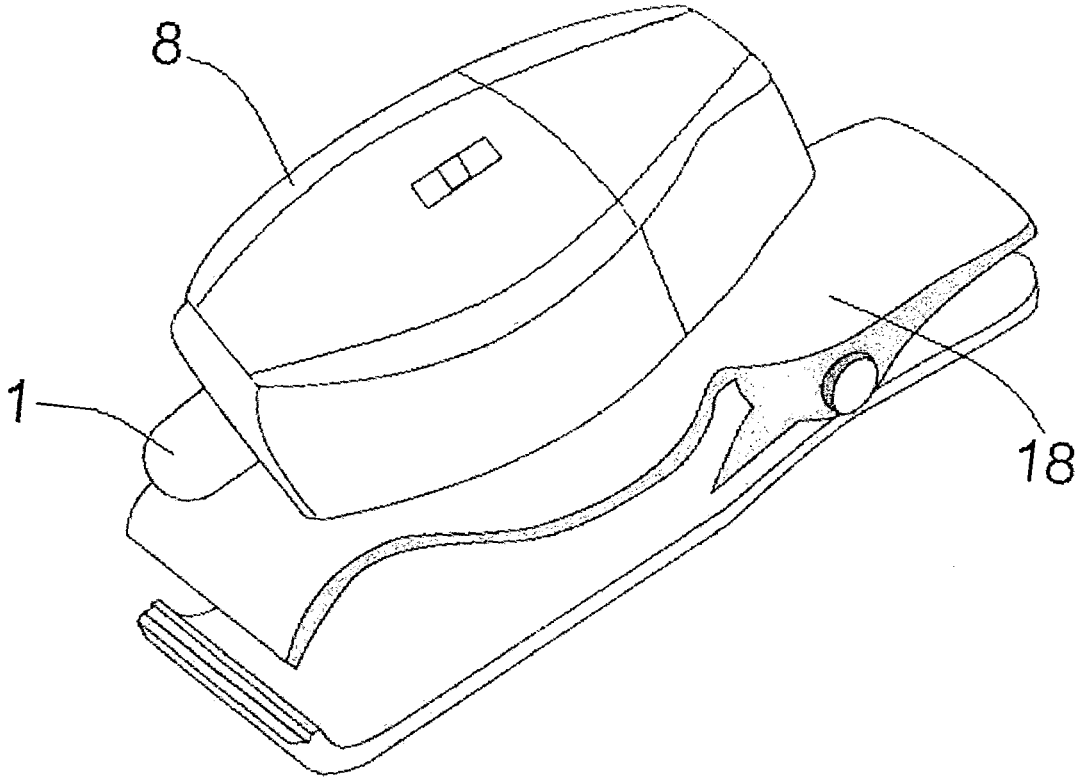
FIG. 4: shows a view of the lighting device according to the invention assembled on a bracket with a clip suitable to be hooked to the upper or vamp of a shoe.

For example, illustrated in FIG. 4 is the lighing device of the invention, with the light source 1 emerging from the housing 8 assembled on a bracket with a clip 18 suitable to be hooked to the upper or vamp of a shoe.

The lighting device of the invention as above illustrated, can be hooked to any type of shoe and compared to shoes with lighting system incorporated above described, has therefore an ulterior advantage both in manufacture, given that the same device of standard dimensions is suitable for any type and length of shoe, and in its use, as the same device could be used by the same person on many shoes.

What is claimed is:

1. A shoe supplied with a lighting system to light the way of who wears them, comprising a light source assembled on the external anterior surface of the shoe, a battery that powers said light source, a button positioned inside the inner sole of the shoe and activated by the pressure of the foot of support when walking, and a circuit connected to said button and to said light source by means of wires, said circuit controlling the lighting of said light source following the pressing of said button and on which a timer is set, such that if at a first pressing of the button, a second pressing does not follow in a predetermined period of time, the light source goes off, wherein said light source is inserted in a housing assembled on the external anterior surface of the shoe, optionally supplied with an opening suitable to contain the light source in such a way that it emits a beam of light directed frontally to light up the way of who wears the shoe.

2. The shoe according to claim 1, further comprising an on-off switch on said housing in such a way to be able to be operated by who wears the shoe.

3. The shoe according to claim 1, in which said light source is a light emitting diode (LED).

4. The shoe according to claim 1, in which said battery is a lithium battery.

5. The shoe according to claim 1, in which said battery is comprised in said circuit.

6. The shoe according to claim 1, in which said battery is inserted inside said housing.

7. The shoe according to claim 1, in which said circuit is a SMT circuit miniaturized.

8. The shoe according to claim 1, in which said circuit is inserted inside said housing.

9. The shoe according to claim 1, in which said circuit is inserted inside the heel of said shoe.

10. The shoe according to claim 1, in which on said circuit there is a timer set at a time ranging from 3 to 10 seconds.

11. The shoe according to claim 1, in which on said circuit there is a timer set at a time of 5 seconds.

12. An inner sole for a shoe, comprising a button positioned inside the sole structure and activated by pressure of the foot of support when walking, a light source inserted in a suitable housin assembled on a bracket with a clip suitable to be hooked to the upper or vamp of a shoe and optionally supplied with an opening, a battery that powers said light source and a circuit connected to said button and to said light source by way of wires, that actuate lighting of said light source following pressing of said button and on which a timer is set such that if at a first pressing of the button, another pressing does not follow in a predetermined period of time, the light source goes off.

13. The inner sole according to claim 12, in which said light source is a light emitting diode (LED), supplied with an on-off switch for operation by the user.

14. The inner sole according to claim 12, in which said battery is a lithium battery.

15. The inner sole according to claim 12, in which said circuit is a SMT circuit miniaturized.

16. The inner sole according to claim 12, in which said circuit is inserted in said housing.

17. The inner sole according to claim 12, in which said circuit is inserted inside the heel of said sole.

18. The inner sole according to claim 12, in which on said circuit there is a timer set at a time ranging from 3 to 10 seconds.

19. The inner sole according to claim 18, in which on said circuit there is a timer set at 5 seconds.

20. A shoe comprising an inner sole, comprising a button positioned inside the sole structure and activated by pressure of the foot of support when walking, a light source inserted in a suitable housing assembled on a bracket with a clip suitable to be hooked to the upper or vamp of a shoe and optionally supplied with an opening, a battery that powers said light source and a circuit connected to said button and to said light source by way of wires, that actuate lighting of said light source following pressing of said button and on which a timer is set such that if at a first pressing of the button, another pressing does not follow in a predetermined period of time, the light source goes off.

21. A lighting device for shoes comprising a light source, a battery that powers the said light source, an on-off switch, a circuit connected to a balance switch and to the light source that activates lighting of the light source following movement of the shoe and on which a timer is set, such that if at a first movement of the shoe, another movement does not follow in a predetermined time, the light goes off, said battery, circuit, on-off switch and balance switch being inserted inside a housing supplied with a means of fastening to the shoe and of at least one opening, said light source emerging from an extremity of the housing from which light emits, and said on-off switch being external to said housing, in such a way that who wears the shoe can operate it.

22. The device according to claim 21, in which said light source is a light emitting diode (LED).

23. The device according to claim 21, in which said battery is a lithium battery.

24. The device according to claim 21, in which said circuit is a SMT circuit miniaturized.

25. The device according to claim 21, in which on said circuit there is a timer set at a time ranging between 3 and 10 seconds.

26. The device according to claim 25, in which on said circuit there is a timer set at a time of 5 seconds.

27. The device according to claim 21, in which said balance switch is a sphere or spring balance switch.

28. The device according to claim 21, in which said housing is a rigid container in plastic material, and said fastening means to the shoe is a bracket supplied with two or more holes through which it is sewn to the upper-vamp-of the shoe, said bracket being eventually supplied with a protuberance to engage itself with the corresponding opening made in the device.

* * * * *